US008037711B1

(12) United States Patent
Mesaros et al.

(10) Patent No.: US 8,037,711 B1
(45) Date of Patent: Oct. 18, 2011

(54) PORTABLE DRY ICE HOLDING CONTAINER FOR USE WITH A SWIMMING POOL AND ASSOCIATED METHOD

(76) Inventors: Susan Mesaros, Allentown, PA (US); Stanley Mesaros, Allentown, PA (US)

( * ) Notice: Subject to any disclaimer, the term of this patent is extended or adjusted under 35 U.S.C. 154(b) by 517 days.

(21) Appl. No.: 12/319,251

(22) Filed: Jan. 6, 2009

Related U.S. Application Data

(60) Provisional application No. 61/062,095, filed on Jan. 24, 2008.

(51) Int. Cl.
*F25D 3/12* (2006.01)
*B63B 22/00* (2006.01)

(52) U.S. Cl. ..... 62/384; 441/1

(58) Field of Classification Search ..... 62/165, 62/166, 45.1; 441/32, 33, 34, 21, 23–26; 239/6, 8, 9, 10, 13, 38, 49, 60, 650, 654, 239/662, 682, 683, 686, 689, 128, 373, 374; 222/1, 3, 173, 229, 252, 4, 146.6, 189.11, 222/322, 323, 330, 466, 191, 192, 631, 196.5, 222/469, 470, 478; 220/560, 560.04, 560.09, 220/752, 756, 770; 446/15, 153, 154, 424, 446/483, 475
See application file for complete search history.

(56) References Cited

U.S. PATENT DOCUMENTS

| | | | | |
|---|---|---|---|---|
| 316,198 | A * | 4/1885 | Speicher | 239/686 |
| 1,903,171 | A | 3/1933 | Cordrey | |
| 3,428,977 | A * | 2/1969 | Jones | 441/24 |
| 3,431,569 | A * | 3/1969 | Gerke | 441/6 |
| 5,503,198 | A | 4/1996 | Becker | |
| 6,209,341 | B1 | 4/2001 | Beneditti | |
| 7,186,162 | B2 * | 3/2007 | Chiang | 446/153 |
| 2010/0024441 | A1 * | 2/2010 | Yeung | 62/56 |

* cited by examiner

*Primary Examiner* — Judy Swann
*Assistant Examiner* — Ignacio E Landeros

(57) ABSTRACT

A portable dry ice holding container for cooling water contained in an existing swimming pool may include a buoyant cartridge with open first end and closed second end. A lid may be removably connected to the first end to form a cavity between the first and second ends. A unitary outer surface may extend between the ends, preferably having apertures formed therein for permitting water to ingress and egress the cavity. A handle may be penetrated through the outer surface, traversing the cavity with opposed ends remaining situated exterior. Dry ice may be removably seated inside the cavity and may interact with and lower the temperature of the water. A mechanism may agitate the water inside the cavity through linear reciprocation of the handle to increase a flow rate through the cavity. Such a mechanism may include a plurality of curvilinear blades rotatably coupled to the handle within the cavity.

17 Claims, 3 Drawing Sheets

PORTABLE DRY ICE HOLDING CONTAINER FOR USE WITH A SWIMMING POOL AND ASSOCIATED METHOD

CROSS REFERENCE TO RELATED APPLICATIONS

This application claims the benefit of U.S. Provisional Application No. 61/062,095, filed Jan. 24, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to swimming pool water temperature controllers and, more particularly, to a portable dry ice holding container for cooling water contained in an existing swimming pool.

PRIOR ART

Human beings are known for their ability to adapt to their environment or, to adapt their environment to them. One example of this quality is the continued expansion of human populations into areas previously deemed inhospitable to human life. Desert communities such as Phoenix, Ariz. and Las Vegas, Nev. are two well-known and rapidly growing areas which support burgeoning populations. In order to survive in these hot, desert climates, most structures designed for human occupation are provided with a means for the occupants to cool themselves, namely the well known swimming pool. The difficulty is that in these areas, and others that do not have such extreme temperatures, the ambient temperature raises the temperature of the water contained in even the largest of pools to such an extent that it is not comfortable to swim therein.

U.S. Pat. No. 1,903,171 to Cordrey discloses a receptacle for shipping and storing sold $CO_2$ and similar vaporized substances having very low temperatures. The receptacle includes a double-walled construction having a removable top and closed bottom. The bottom and side walls are gas impervious except near the upper edges where perforations allow the passage of gases given off by the solid substances housed therein. Unfortunately, this prior art reference is intended for storage and transportation of dry ice and is not buoyant or suitable for use in a swimming pool to provide a cooling effect on the water therein.

U.S. Pat. No. 6,209,341 to Benedetti discloses a dry ice container comprising a casing used to house carbon dioxide in both sold and gaseous forms. The casing has at least one passage for permitting carbon dioxide gas to escape and at least one passage for insertion of carbon dioxide into the container. The casing is further made of porous material having pores forming passages for spontaneous escape of gases. Unfortunately, this prior art reference also is not intended to float or be utilized in a swimming pool to assist in reducing water temperature, and would not be suitable for this purpose.

U.S. Pat. No. 5,795,551 to Powell discloses a floating dispenser with an inlet port and an outlet port. The floating dispenser contains swimming pool chlorinating chemicals. The dispenser floats in the swimming pool, gradually distributing chlorine into the pool out of an outlet port by way of a dissolving plug. Unfortunately, while this type of dispenser may be adapted to gradually distribute a cooling agent, this prior art reference does not disclose, nor is it obvious to employ, a water agitating mechanism to increase a flow rate through the dispenser to more rapidly utilize its contents.

Accordingly, a need remains for a portable dry ice holding container in order to overcome the above-noted shortcomings. The present invention satisfies such a need by providing an apparatus that is convenient and easy to use, is durable yet lightweight in design, is versatile in its applications, and provides a method of cooling water contained in an existing swimming pool.

BRIEF SUMMARY OF THE INVENTION

In view of the foregoing background, it is therefore an object of the present invention to provide an apparatus for cooling water contained in an existing swimming pool. These and other objects, features, and advantages of the invention are provided by a portable dry ice holding container.

A portable dry ice holding container for cooling water contained in an existing swimming pool may include a buoyant cartridge adapted to be removably positioned in the existing swimming pool. Such a buoyant cartridge may include a first end and a second end oppositely spaced therefrom. The second end may be closed and the first end may be open. The cartridge may be suitably sized and shaped to allow for easy transportation, and so as not to interfere with the user's enjoyment of the swimming pool while the container is being employed in the water.

Additionally, a lid may be removably connected directly to the first end of the buoyant cartridge such that a cavity may be formed between the first and second ends of the buoyant cartridge. The lid may permit the user to access the contents of the cartridge and refill it as necessary. Additionally, the lid may include an eyelet directly affixed thereto for permitting the user to hang and store the container when not in use. The cartridge may also include a unitary outer surface extending between the first and second ends. Such an outer surface may have a plurality of spaced apertures formed therein for permitting the swimming pool water to ingress and egress the cavity respectively. In this manner, as the cartridge is kept afloat in the pool due to the buoyant material preferably used to manufacture its components, water may flow in and out of the cavity through the apertures to contact a cooling agent housed therein.

The buoyant cartridge may also include a handle preferably penetrated through the outer surface of the cartridge and traversing the cavity such that opposed ends of the handle remain continuously situated exterior of the cavity. This may assist a user to retrieve the buoyant cartridge without directly contacting the outer surface of the buoyant cartridge, which is advantageous when the cavity houses a particularly cooling agent that may reduce the temperature of the outer surface enough to be unfavorable to skin contact. In addition, the handle may have a generally oval shape and may intersect the buoyant cartridge.

Further, a predetermined volume of dry ice may be removably seated inside the buoyant cartridge such that the dry ice may remain confined within the cavity. The dry ice may interact with the swimming pool water inside the cavity and thereby lower a temperature of the swimming pool water prior to egressing the buoyant cartridge. The dry ice may be in the form of pellets to allow the user to easily open the lid of the cartridge and refill the cavity with the ice prior to use.

The portable dry ice holding container further may include a mechanism for agitating the swimming pool water inside the cavity by linearly reciprocating the handle along a bi-directional linear path registered orthogonal to a longitudinal length of the buoyant cartridge. This may operate so that a flow rate of the swimming pool water may be increased while ingressing and egressing through the apertures. The agitating mechanism may additionally include a plurality of curvilinear blades rotatably coupled to the handle and housed inside the cavity.

The blades may be configured in such a manner that the blades may automatically rotate along mutually exclusive curvilinear paths defined inside the cavity when the handle is linearly reciprocated along the bi-directional linear path. The blades may additionally include slots formed along a longitudinal length thereof for permitting water to flow therethrough, in effect causing the blades to rotate as the handle is reciprocated by the user. This may operate such that the swimming pool water may be respectively urged into and out from the apertures while the buoyant cartridge floats in the swimming pool. Such an action is vital and advantageous to allow further cooling effects on a larger volume of the water in the pool, as warm water may flow in quickly and be released back into the pool at a lower temperature.

The handle may additionally include first and second linear regions traversing through the cavity and remaining oriented parallel to the bi-directional path during agitation operations. The first and second linear regions further may be spaced apart at a fixed linear spatial distance inside the cavity. Also, the blades may be concentrically conjoined about the first and second linear regions respectively such that the mutually exclusive arcuate paths may be defined about the first and second linear regions respectively. The fixed spatial distance of the linear regions and their corresponding blades allows the blades to work in conjunction with each other, advantageously allowing for an increased flow rate by the dual, or multi-action of the spinning blades.

Further, the opposed ends of the handle may be diametrically spaced apart and remain situated exterior of the outer surface while the blades are rotatably articulated inside the cavity. This may function so that the user may be able to operate the agitating mechanism while the lid is affixed to the first end of the buoyant cartridge. In operation, if the user is in the swimming pool, they may simply approach the apparatus and reciprocate the handle by pulling it in and out from either side to actuate the mechanism and assist in cooling the pool water.

The portable dry ice holding container may further include the blades being contemporaneously rotated in a clockwise direction when the first and second linear regions are linearly displaced in a first linear direction along the bi-directional path. In addition, the blades may be contemporaneously rotated in a counter clockwise direction when the first and second linear regions are linearly displaced in a second linear direction along the bi-directional path. The first linear direction may travel opposite to the second linear direction. Alternating directions may permit the water to flow back and forth within the cavity to continuously reposition the dry ice within the cavity to ensure contact with new water flowing in through the apertures.

The present invention may further include a method for cooling water contained in an existing swimming pool. Such a method may include the chronological steps of first providing and removably positioning a buoyant cartridge in the existing swimming pool. The buoyant cartridge preferably includes a first end and a second end oppositely spaced therefrom. The second end may be closed and the first end may be open. In addition, a lid may be removably connected directly to the first end of the buoyant cartridge such that a cavity may be formed between the first and second ends of the buoyant cartridge. Further, the cartridge may include a unitary outer surface extending between the first and second ends. The outer surface may have a plurality of spaced apertures formed therein for permitting the swimming pool water to ingress and egress the cavity respectively.

A second step of the method may include providing and penetrating a handle through the outer surface of the buoyant cartridge by traversing the handle through the cavity. The handle may have a generally oval shape and may intersect the buoyant cartridge. Third, the method may include continuously maintaining opposed ends of the handle situated exterior of the cavity to assist a user to retrieve the buoyant cartridge without directly contacting the outer surface of the buoyant cartridge. Fourthly, the method may include providing and removably seating a predetermined volume of dry ice inside the buoyant cartridge by detaching the lid from the first end of the buoyant cartridge. Thereafter, the method may entail attaching the lid to the first end of the buoyant cartridge such that the dry ice remains confined within the cavity. Finally, a sixth step preferably includes the dry ice interacting with the swimming pool water inside the cavity and thereby lowering a temperature of the swimming pool water prior to egressing the buoyant cartridge.

The method provides the unexpected and unpredictable benefit of allowing a user to easily reduce the temperature of an existing swimming pool in times of elevated heat. This is vital and advantageous in areas of warmer climates where water temperatures in summer months normally provide little comfort for those wishing to cool down. By simply filling the cartridge with dry ice, and operating the agitating mechanism as needed, a user may provide a cooling effect on the water that provides a relaxing and comfortable water environment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
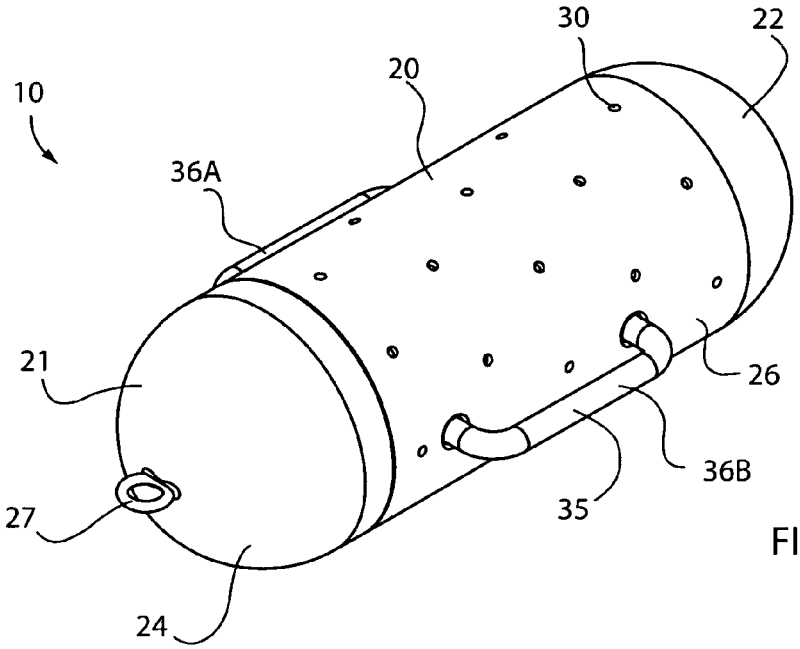
FIG. 1 is a perspective view showing a portable dry ice holding container, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a portable dry ice holding container. It should be understood that the portable dry ice holding container 10 may be used to cool water contained in many different types and sizes of swimming pools and other recreational water containers. Further, the present invention may be used to keep perishables from rotting and spoiling; cool down Industrial moving parts; cool the ocean water by creating attachments to ships that can be refilled when ship is in port; and cool air flow down stream of wind turbines.

Referring initially to FIGS. 1-5, a portable dry ice holding container 10 for cooling water contained in an existing swimming pool may include a buoyant cartridge 20 adapted to be removably positioned in the existing swimming pool 11. Such a buoyant cartridge 20 may include a first end 21 and a second end 22 oppositely spaced therefrom. The second end 22 may be closed and the first end 21 may be open. The cartridge 20 may be suitably sized and shaped to allow for easy transportation, and so as not to interfere with the user's enjoyment of the swimming pool 11 while the container 10 is being employed in the water.

Additionally, a lid 24 may be removably connected directly to the first end 21 of the buoyant cartridge 20 such that a cavity 25 may be formed between the first and second ends 21, 22 of the buoyant cartridge 20. The lid 24 may permit the user to access the contents of the cartridge 20 and refill it as necessary. Additionally, the lid 24 may include an eyelet 27 directly affixed thereto for permitting the user to hang and store the container 10 when not in use.

The cartridge 20 may also include a unitary outer surface 26 extending between the first and second ends 21, 22. Such an outer surface 26 may have a plurality of spaced apertures 30 formed therein for permitting the swimming pool water to ingress and egress the cavity 25 respectively. In this manner, as the cartridge 20 is kept afloat in the pool 11 due to the buoyant material preferably used to manufacture its components, water may flow in and out of the cavity 25 through the apertures 30 to contact a cooling agent housed therein.

Figure 2:
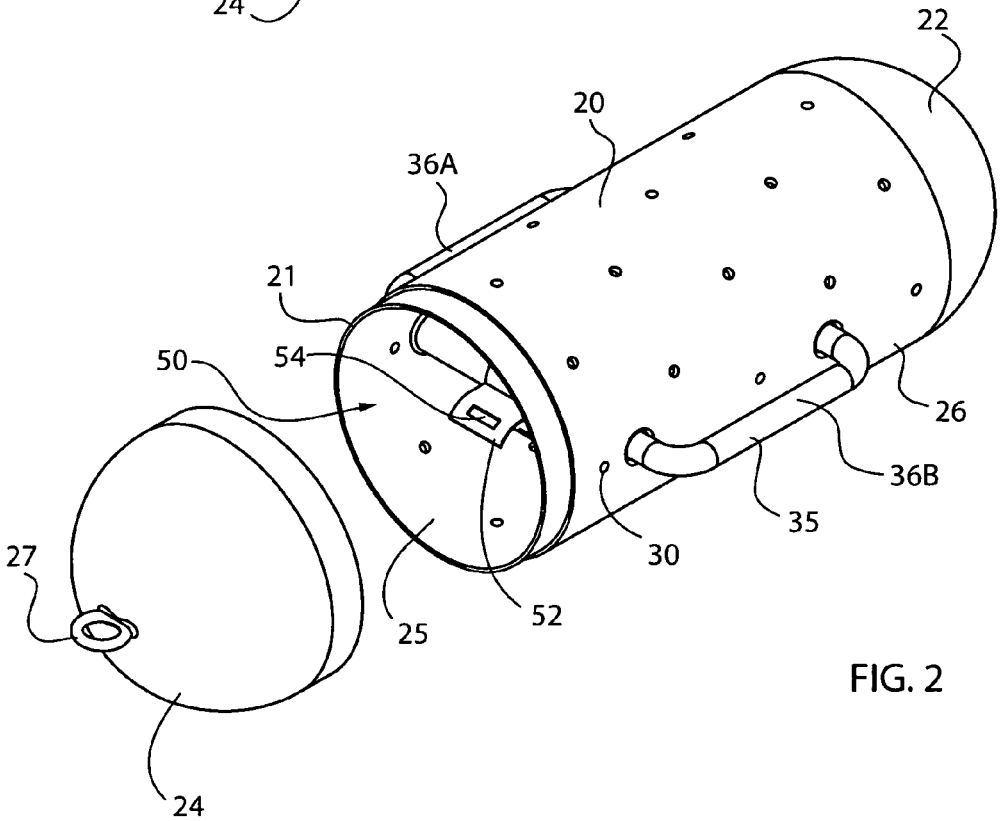
FIG. 2 is a perspective view of the apparatus shown in FIG. 1, with the lid detached and showing the blades within the cavity of the cartridge.
Figure 4:
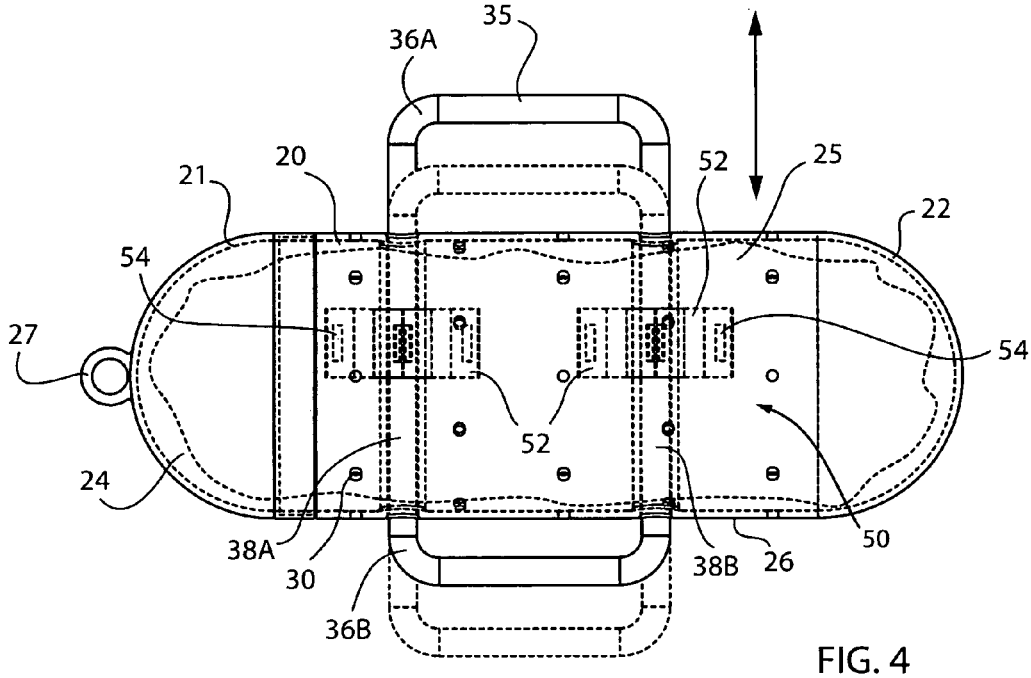
FIG. 4 is a cross-sectional top view of the apparatus shown in FIG. 1, displaying the agitating mechanism with the handle being linearly displaced along the bi-directional path.
Figure 5:
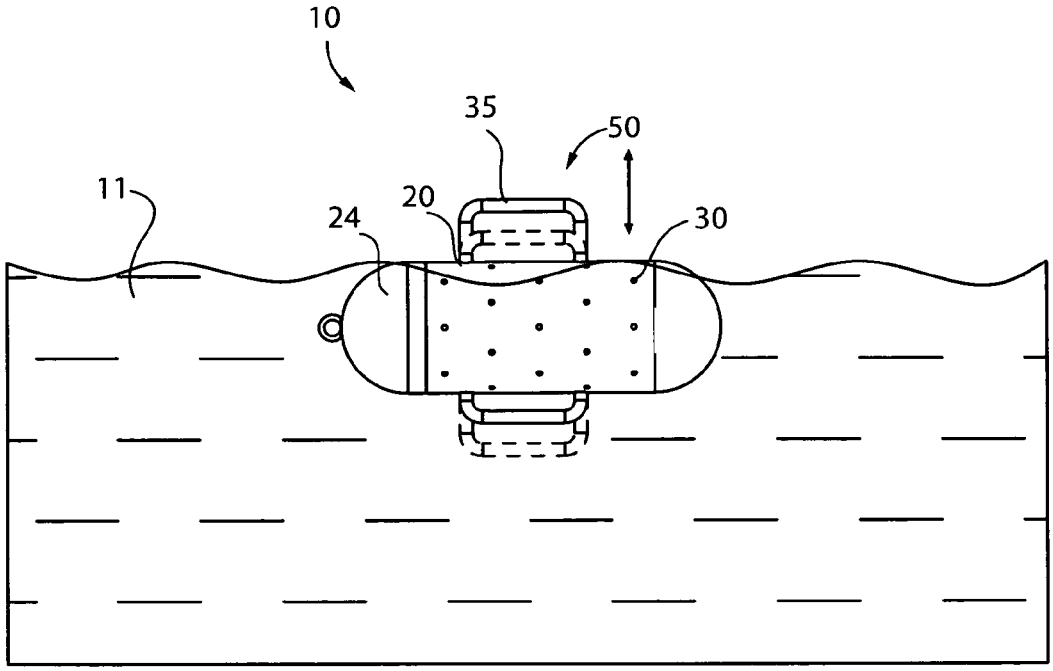
FIG. 5 is a side elevational view of the apparatus shown in FIG. 1, displaying the apparatus in operation within a body of water.

Referring now to FIGS. 1, 2, and 4, the buoyant cartridge 20 may also include a handle 35 preferably penetrated through the outer surface 26 of the cartridge 20 and traversing the cavity 25 such that opposed ends 36A, 36B of the handle 35 may remain continuously situated exterior of the cavity 25. This may assist a user to retrieve the buoyant cartridge 20 without directly contacting the outer surface 26 of the buoyant cartridge 20, which is advantageous when the cavity 25 houses a particularly cold cooling agent that may reduce the temperature of the outer surface 26 enough to be unfavorable to skin contact. In addition, the handle 35 may have a generally oval shape and may intersect the buoyant cartridge 20.

Figure 3:
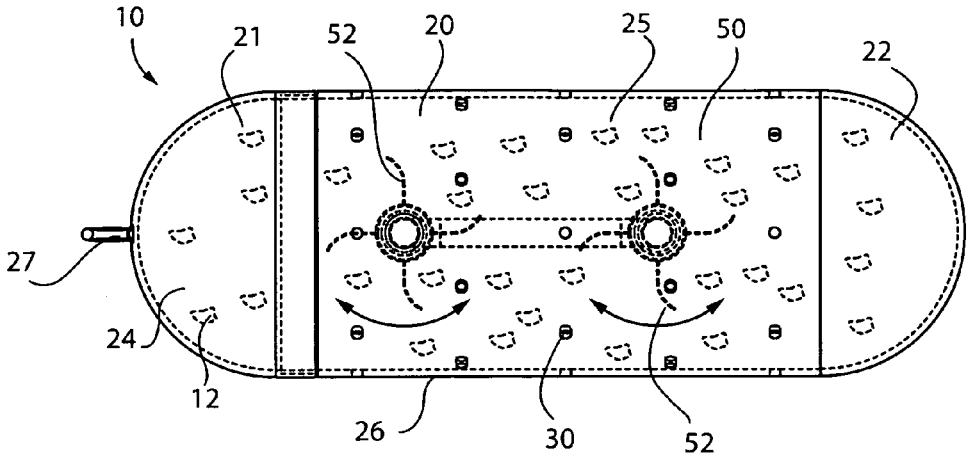
FIG. 3 is a cross-sectional side view of the apparatus shown in FIG. 1, showing the dry ice distributed throughout the cartridge and the rotating action of the blades.

Now referring specifically to FIG. 3, a predetermined volume of dry ice 12 may be removably seated inside the buoyant cartridge 20 such that the dry ice 12 may remain confined within the cavity 25. The dry ice 12 may interact with the swimming pool water inside the cavity 25 and thereby lower a temperature of the swimming pool water prior to egressing the buoyant cartridge 20. The dry ice 12 may be in the form of pellets to allow the user to easily open the lid 24 of the cartridge 20 and refill the cavity 25 with the ice 12 prior to use. Such claimed elements provide an unpredictable and unexpected result which is not rendered obvious by one skilled in the art.

Referring now to FIGS. 1-4, the portable dry ice holding container 10 further may include a mechanism 50 for agitating the swimming pool water inside the cavity 25 by linearly reciprocating the handle 35 along a bi-directional linear path registered orthogonal to a longitudinal length of the buoyant cartridge 20. This may operate so that a flow rate of the water may be increased while ingressing and egressing through the apertures 30.

The agitating mechanism 50 may additionally include a plurality of curvilinear blades 52 rotatably coupled to the handle 35 and housed inside the cavity 25. The blades 52 may be configured in such a manner that the blades 52 may automatically rotate along mutually exclusive curvilinear paths defined inside the cavity 25 when the handle 35 is linearly reciprocated along the bi-directional linear path. Such a rotating motion of the blades 52 is advantageously achieved by way of slots 54 formed along a latitudinal width of the blades 52.

In particular, the combination of the blades' 52 curvilinear longitudinal lengths traversing the slots 54, and the buoyancy of cartridge 20, causes water to flow through slots 54 as the linear arms are reciprocated, and thereby create a tangential force along the top and bottom surface of blades 52. Such tangential forces cause the blades 52 to rotate as the handle 35 is linearly reciprocated by the user. This may operate such that the swimming pool water may be respectively urged into and out from the apertures 30 while the buoyant cartridge 20 floats in the swimming pool 11. Such an action is vital and advantageous to allow further cooling effects on a larger volume of water within the pool 11, as warm water may flow in quickly and be released back into the pool 11 at a lower temperature. The combination of the slotted blades 52 with the reciprocating action of the handle 35 provides an unexpected and unpredictable result not rendered obvious by one skilled in the art because it permits the user to increase water flow into and out from the cartridge 20 cavity without touching the dry ice housed therein.

Now referring to FIGS. 2 and 4, the handle 35 may additionally include first and second linear regions 38A, 38B traversing through the cavity 25 and remaining oriented parallel to the bi-directional path during agitation operations. The first and second linear regions 38A, 38B further may be spaced apart at a fixed linear spatial distance inside the cavity 25. Also, the blades 52 may be concentrically conjoined about the first and second linear regions 38A, 38B respectively such that the mutually exclusive arcuate paths may be defined about the first and second linear regions 38A, 38B respectively. The fixed spatial distance of the linear regions 38A, 38B and their corresponding blades 52 allows the blades 52 to work in conjunction with each other, advantageously allowing for an increased flow rate by the dual, or multi-action rotating of the blades 52.

Further, the opposed ends 36A, 36B of the handle 35 may be diametrically spaced apart and remain situated exterior of the outer surface 26 while the blades 52 are rotatably articulated inside the cavity 25. This may function so that the user may be able to operate the agitating mechanism 50 while the lid 24 is affixed to the first end 21 of the buoyant cartridge 20. In operation, if the user is in the swimming pool 11, they may simply approach the apparatus 10 and reciprocate the handle 35 by pulling it in and out from either side to actuate the mechanism 50 and assist in cooling the pool water.

Referring specifically to FIG. 3, the portable dry ice holding container 10 may further include the blades 52 being contemporaneously rotated in a clockwise direction when the first and second linear regions 38A, 38B are linearly displaced in a first linear direction along the bi-directional path. In addition, the blades 52 may be contemporaneously rotated in a counter clockwise direction when the first and second linear regions 38A, 38B are linearly displaced in a second linear direction along the bi-directional path. The first linear direction may travel opposite to the second linear direction. Alternating directions may permit the water to flow back and forth within the cavity 25 to continuously reposition the dry ice 12 within the cavity 25 to ensure contact with new water flowing in through the apertures 30.

Referring in general to FIGS. 1-5, the present invention may further include a method for cooling water contained in an existing swimming pool 11. Such a method may include the chronological steps of first providing and removably positioning a buoyant cartridge 20 in the existing swimming pool 11. The buoyant cartridge 20 preferably includes a first end 21 and a second end 22 oppositely spaced therefrom. The second end 22 may be closed and the first end 21 may be open.

In addition, a lid 24 may be removably connected directly to the first end 21 of the buoyant cartridge 20 such that a cavity 25 may be formed between the first and second ends 21, 22 of the buoyant cartridge 20. Further, the cartridge 20 may include a unitary outer surface 26 extending between the first and second ends 21, 22. The outer surface 26 may have a plurality of spaced apertures 30 formed therein for permitting the swimming pool water to ingress and egress the cavity 25 respectively.

A second step of the method may include providing and penetrating a handle 35 through the outer surface 26 of the buoyant cartridge 20 by traversing the handle 35 through the cavity 25. The handle 35 may have a generally oval shape and may intersect the buoyant cartridge 20. Third, the method may include continuously maintaining opposed ends 36A, 36B of the handle 35 situated exterior of the cavity 25 to assist a user to retrieve the buoyant cartridge 20 without directly contacting the outer surface 26 of the buoyant cartridge 20.

Fourthly, the method may include providing and removably seating a predetermined volume of dry ice 12 inside the buoyant cartridge 20 by detaching the lid 24 from the first end of the buoyant cartridge 20. Thereafter, the method may entail attaching the lid 24 to the first end of the buoyant cartridge 20 such that the dry ice 12 remains confined within the cavity 25. Finally, a sixth step preferably includes the dry ice 12 interacting with the swimming pool 11 water inside the cavity 25 and thereby lowering a temperature of the swimming pool 11 water prior to egressing the buoyant cartridge 20.

The present invention 10 and method, as claimed, provides the unexpected and unpredictable benefit of allowing a user to reduce the temperature of a swimming pool through the easy to operate and conveniently designed dry ice container 10 with water agitating mechanism 50. The present invention 10 further is not rendered obvious by one skilled in the art and is designed to assist a user in providing a more relaxing and amiable environment in which to spend hot summer days. Besides being easily operable, the apparatus 10 may be conveniently shaped and sized to prevent interfering with a user's enjoyment of the swimming pool while in use.

In an alternate embodiment, the apparatus 10 may include an additional mechanism designed to rapidly propel water out of the cartridge in a steady stream. Such a mechanism may be beneficial in that it may create an entertaining action that may allow users to direct the water at each other, further taking advantage of the cooled water and heat reduction effects during intensely heated summer days. Additional embodiments may include the agitating mechanism operated by a variety of means, including a pull cord, spring actuated handle, or a pressurized pumping mechanism.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable dry ice holding container for cooling water contained in an existing swimming pool, said portable dry ice holding container comprising:

a buoyant cartridge adapted for being removably positioned in the existing swimming pool, said buoyant cartridge including a first end and a second end oppositely spaced therefrom, said second end being closed and said first end being open, a lid removably connected directly to said first end of said buoyant cartridge such that a cavity is formed between said first and second ends of said buoyant cartridge, and a unitary outer surface extending between said first and second ends, said outer surface having a plurality of spaced apertures formed therein for permitting the swimming pool water to ingress and egress said cavity respectively;

a handle penetrated through said outer surface of said buoyant cartridge and traversing said cavity such that opposed ends of said handle remain continuously situated exterior of said cavity for assisting a user to retrieve said buoyant cartridge without directly contacting said outer surface of said buoyant cartridge; and a predetermined volume of dry ice removably seated inside said buoyant cartridge such that said dry ice remains confined within said cavity;

wherein said dry ice interacts with the swimming pool water inside said cavity and thereby lowers a temperature of the swimming pool water prior to egressing said buoyant cartridge wherein said handle includes means for agitating the swimming pool water inside said cavity by linearly reciprocating said handle relative to said container along a bi-directional linear path.

2. The portable dry ice holding container of claim 1, further comprising:

linearly reciprocating said handle along a bi-directional linear path registered orthogonal to a longitudinal length of said buoyant cartridge so that a flow rate of the swimming pool water is increased while ingressing and egressing through said apertures.

3. The portable dry ice holding container of claim 2, wherein said agitating means comprises:

a plurality of curvilinear blades rotatably coupled to said handle and housed inside said cavity, said blades being configured in such a manner that said blades automatically rotate along mutually exclusive curvilinear paths defined inside said cavity when said handle is linearly reciprocated along the bi-directional linear path such that the swimming pool water is respectively urged into and out from said apertures while said buoyant cartridge floats in the swimming pool.

4. The portable dry ice holding container of claim 3, wherein said handle comprises:

first and second linear regions traversing through said cavity and remaining oriented parallel to the bi-directional path during agitation operations, said first and second linear regions further being spaced apart at a fixed linear spatial distance inside said cavity;

wherein said blades are concentrically conjoined about said first and second linear regions respectively such that said mutually exclusive arcuate paths are defined about said first and second linear regions respectively.

5. The portable dry ice holding container of claim 4, wherein each of said blades is provided with a slot formed along a latitudinal width thereof such that water is passed therethrough and thereby causes said blades to contemporaneously rotate in a clockwise direction when said first and second linear regions are linearly displaced in a first linear direction along said bi-directional path.

6. The portable dry ice holding container of claim 5, wherein said blades are contemporaneously rotated in a counter clockwise direction when said first and second linear regions are linearly displaced in a second linear direction along said bi-directional path.

7. The portable dry ice holding container of claim 6, wherein said first linear direction travels opposite to said second linear direction.

8. The portable dry ice holding container of claim 4, wherein said opposed ends of said handle are diametrically spaced apart and remain situated exterior of said outer surface while said blades are rotatably articulated inside said cavity so that the user is able to operate said agitating means while said lid is affixed to said first end of said buoyant cartridge.

9. A portable dry ice holding container for cooling water contained in an existing swimming pool, said portable dry ice holding container comprising:

a buoyant cartridge adapted for being removably positioned in the existing swimming pool, said buoyant cartridge including a first end and a second end oppositely spaced therefrom, said second end being closed and said first end being open, a lid removably connected directly to said first end of said buoyant cartridge such that a cavity is formed between said first and second ends of said buoyant cartridge, and a unitary outer surface extending between said first and second ends, said outer surface having a plurality of spaced apertures formed therein for permitting the swimming pool water to ingress and egress said cavity respectively;

a handle penetrated through said outer surface of said buoyant cartridge and traversing said cavity such that opposed ends of said handle remain continuously situated exterior of said cavity for assisting a user to retrieve said buoyant cartridge without directly contacting said outer surface of said buoyant cartridge; and a predetermined volume of dry ice removably seated inside said buoyant cartridge such that said dry ice remains confined within said cavity; wherein said dry ice interacts with the swimming pool water inside said cavity and thereby lowers a temperature of the swimming pool water prior to egressing said buoyant cartridge;

wherein said handle has a generally oval shape and intersects said buoyant cartridge wherein said handle includes means for agitating the swimming pool water inside said cavity by linearly reciprocating said handle relative to said container along a bi-directional linear path.

10. The portable dry ice holding container of claim 9, further comprising: linearly reciprocating said handle along a bi-directional linear path registered orthogonal to a longitudinal length of said buoyant cartridge so that a flow rate of the swimming pool water is increased while ingressing and egressing through said apertures.

11. The portable dry ice holding container of claim 10, wherein said agitating means comprises:

a plurality of curvilinear blades rotatably coupled to said handle and housed inside said cavity, said blades being configured in such a manner that said blades automatically rotate along mutually exclusive curvilinear paths defined inside said cavity when said handle is linearly reciprocated along the bi-directional linear path such that the swimming pool water is respectively urged into and out from said apertures while said buoyant cartridge floats in the swimming pool.

12. The portable dry ice holding container of claim 11, wherein said handle comprises:

first and second linear regions traversing through said cavity and remaining oriented parallel to the bi-directional path during agitation operations, said first and second linear regions further being spaced apart at a fixed linear spatial distance inside said cavity;

wherein said blades are concentrically conjoined about said first and second linear regions respectively such that said mutually exclusive arcuate paths are defined about said first and second linear regions respectively.

13. The portable dry ice holding container of claim 12, wherein each of said blades is provided with a slot formed along a latitudinal width thereof such that water passes therethrough and thereby causes said blades to contemporaneously rotate in a clockwise direction when said first and second linear regions are linearly displaced in a first linear direction along said bi-directional path.

14. The portable dry ice holding container of claim 13, wherein said blades are contemporaneously rotated in a counter clockwise direction when said first and second linear regions are linearly displaced in a second linear direction along said bi-directional path.

15. The portable dry ice holding container of claim 14, wherein said first linear direction travels opposite to said second linear direction.

16. The portable dry ice holding container of claim 12, wherein said opposed ends of said handle are diametrically spaced apart and remain situated exterior of said outer surface while said blades are rotatably articulated inside said cavity so that the user is able to operate said agitating means while said lid is affixed to said first end of said buoyant cartridge.

17. A method for cooling water contained in an existing swimming pool, said method comprising the chronological steps of:

a. providing and removably positioning a buoyant cartridge in the existing swimming pool, said buoyant cartridge including a first end and a second end oppositely spaced therefrom, said second end being closed and said first end being open, a lid removably connected directly to said first end of said buoyant cartridge such that a cavity is formed between said first and second ends of said buoyant cartridge, and a unitary outer surface extending between said first and second ends, said outer surface having a plurality of spaced apertures formed therein for permitting the swimming pool water to ingress and egress said cavity respectively;

b. providing and penetrating a handle through said outer surface of said buoyant cartridge by traversing said handle through said cavity, said handle having a generally oval shape and intersecting said buoyant cartridge, said handle further including means for agitating the swimming pool water inside the cavity;

c. continuously maintaining opposed ends of said handle situated exterior of said cavity for assisting a user to retrieve said buoyant cartridge without directly contacting said outer surface of said buoyant cartridge;

d. providing and removably seating a predetermined volume of dry ice inside said buoyant cartridge by detaching said lid from said first end of said buoyant cartridge;

e. attaching said lid to said first end of said buoyant cartridge such that said dry ice remains confined within said cavity; and f. linearly reciprocating said handle relative to said container along a bi-directional linear path;

said dry ice interacting with the swimming pool water inside said cavity and thereby lowering a temperature of the swimming pool water prior to egressing said buoyant cartridge.

* * * * *